US006938291B1

(12) United States Patent
Cheng

(10) Patent No.: US 6,938,291 B1
(45) Date of Patent: Sep. 6, 2005

(54) STRUCTURE OF A MUSIC BOX OF A PLAY BED

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 10/847,594

(22) Filed: May 18, 2004

(51) Int. Cl.[7] ..... A63H 33/00
(52) U.S. Cl. ..... 5/658
(58) Field of Search ..... 5/658, 507.1, 503.1, 5/655; 446/227

(56) References Cited

U.S. PATENT DOCUMENTS 3,699,704 A * 10/1972 Hakim ..... 446/227
4,756,109 A * 7/1988 Marcus ..... 446/227
4,904,220 A * 2/1990 Williams et al. ..... 446/227
5,951,360 A * 9/1999 Fearon et al. ..... 446/227
6,413,141 B1 * 7/2002 Putney ..... 446/227
6,629,727 B2 * 10/2003 Asbach et al. ..... 446/227
6,705,950 B2 * 3/2004 Wood et al. ..... 472/118
6,769,952 B1 * 8/2004 Drosendahl et al. ..... 446/227
6,775,517 B2 * 8/2004 Strebl et al. ..... 446/227
2003/0171065 A1 * 9/2003 Greenberg ..... 446/226

* cited by examiner

*Primary Examiner*—Frederick L. Lagman
(74) *Attorney, Agent, or Firm*—Rosenberg, Klein & Lee

(57) ABSTRACT

A music box of a play bed includes a box member used for playing music, and a toy hanger, on which several toys are hung for a small child to play in the play bed; the box member has two fitting holes as well as a fitting cavity on an upper side; hooks are respectively detachably connected with the fitting holes so that the box member can be hung on two adjacent upper horizontal rod parts of the bed frame; various types of hooks are available for suiting various types of bed frames whose rod parts have different shapes; the toy hanger is detachably connected with the fitting cavity at a lower end, and can fold such that it can be removed from the box member, and folded to occupy less space when it is not use.

17 Claims, 12 Drawing Sheets

STRUCTURE OF A MUSIC BOX OF A PLAY BED

BACKGROUND OF THE INVENTION

1. Field of the Invention

The present invention relates to a music box of a play bed, more particularly one, which includes a music box member capable of being fitted on various types of frames of play beds, and a foldable toy hanger detachably fitted to the box member, which has toys hung thereon for small children to play with in the play bed.

2. Brief Description of the Prior Art

Play beds are equipped with music boxes so that music can be played for small children when they are plying or resting in the play beds. And, music boxes of play beds are usually equipped with toy hangers, on which several toys are hung for small children to play with when they are playing in the playing beds.

Conventional music boxes for play beds include a box body, and two hooks upright on two adjacent edges of an upper side thereof, which hooks are connected with respective ones of two upper horizontal rod parts of a frame of a play bed for hanging the box body on the play bed. And, conventional toy hangers include a support arm, a support body, and several holding units, on which toys are hung by means of strings; the support arm is secured to a box member of a music box at a lower end; the support body is hung on an upper end of the support arm; the holding units are connected with the support body, and held substantially horizontal.

The conventional music boxes have disadvantages as followings:

1. There are various types of play bed frames, e.g. those with cylindrical metallic rod parts, and those with square wooden rod parts, and there are play bed frames whose upper horizontal rod parts are arranged at two different heights. Because the hooks are formed on, and together with the box members, they can't be replaced. Consequently, the above music boxes can only be fitted on a certain type of play beds according to the shape of their hooks, incapable of suiting various types of play beds, and having relatively limited use.
2. The toy hangers can't be separated from the box members therefore the music box members can't be used alone when the toy hangers are not needed.
3. The holding units can't be angularly displaced relative to the support body. Consequently, the toy hangers can't be folded to occupy less space when they are not used.

SUMMARY

It is a main object of the present invention to provide a music box of a play bed to overcome the above disadvantages.

The music box of the present invention includes a box member used for playing music, and a toy hanger, on which several toys are hung for a small child to play in the play bed. The box member has two fitting holes on an upper side, and a fitting cavity also on the upper side. Hooks are respectively detachably connected with the fitting holes so that the box member can be hung on two adjacent upper horizontal rod parts of a frame of the play bed; various types of hooks are available for suiting various types of bed frames. The toy hanger is detachably fitted in the fitting cavity at a lower end, and can fold such that it can be removed from the box member, and folded to occupy less space when it is not use.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
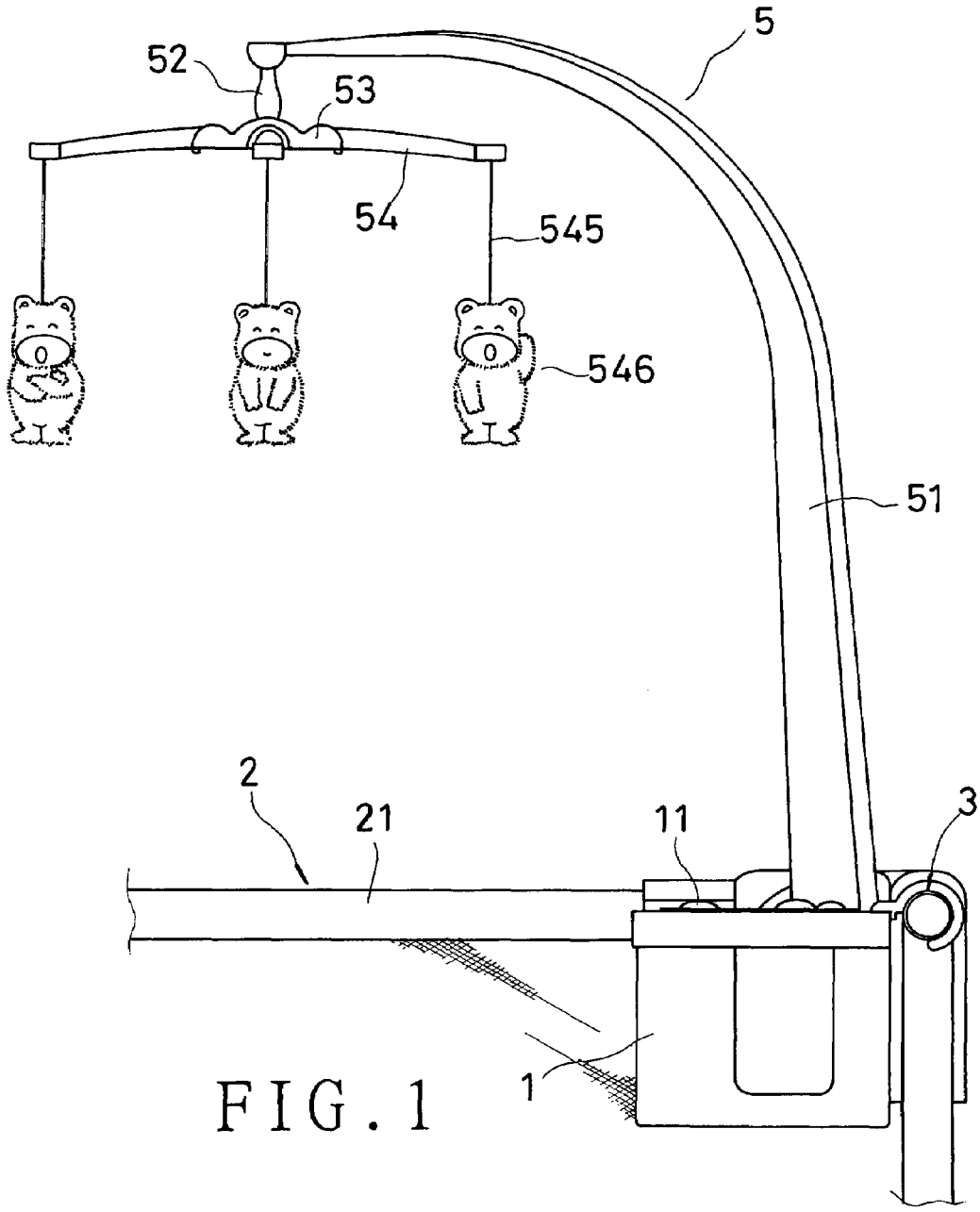
FIG. 1 is a side view of the music box of a play bed according to the present invention.
Figure 2:
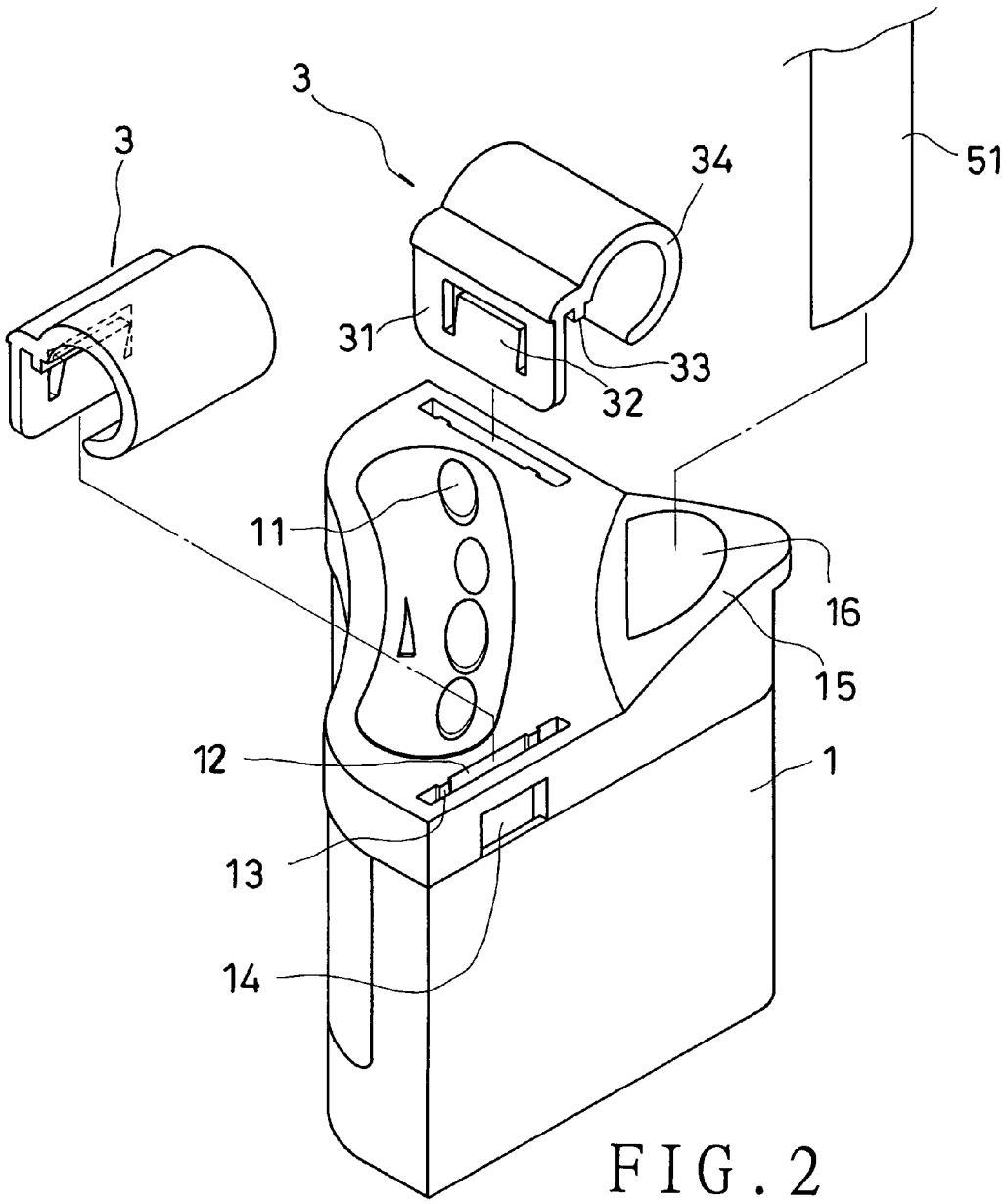
FIG. 2 is a partial exploded perspective view of the music box of the present invention.
Figure 3:
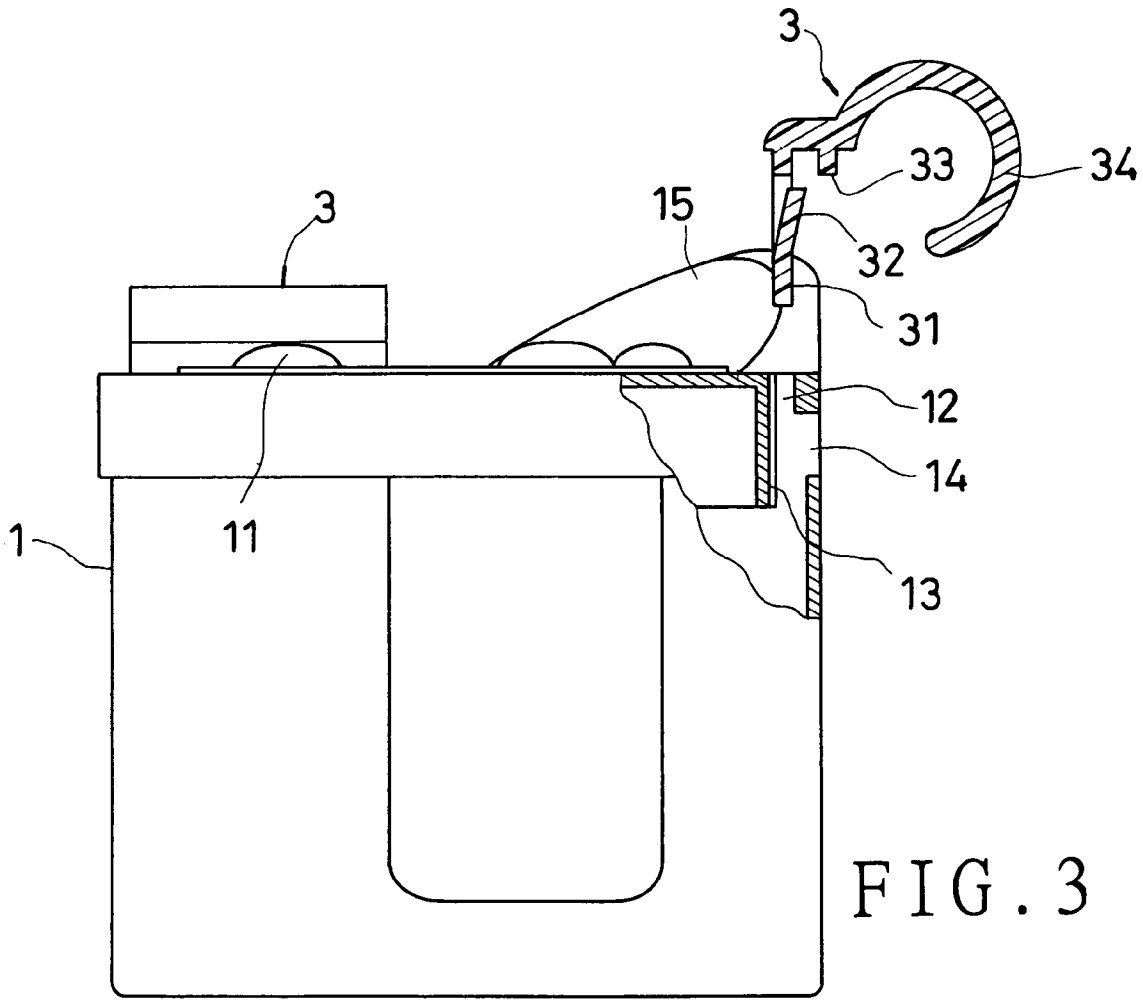
FIG. 3 is a partial vertical section of the present music box, with a hanging hook separated from it.
Figure 9:
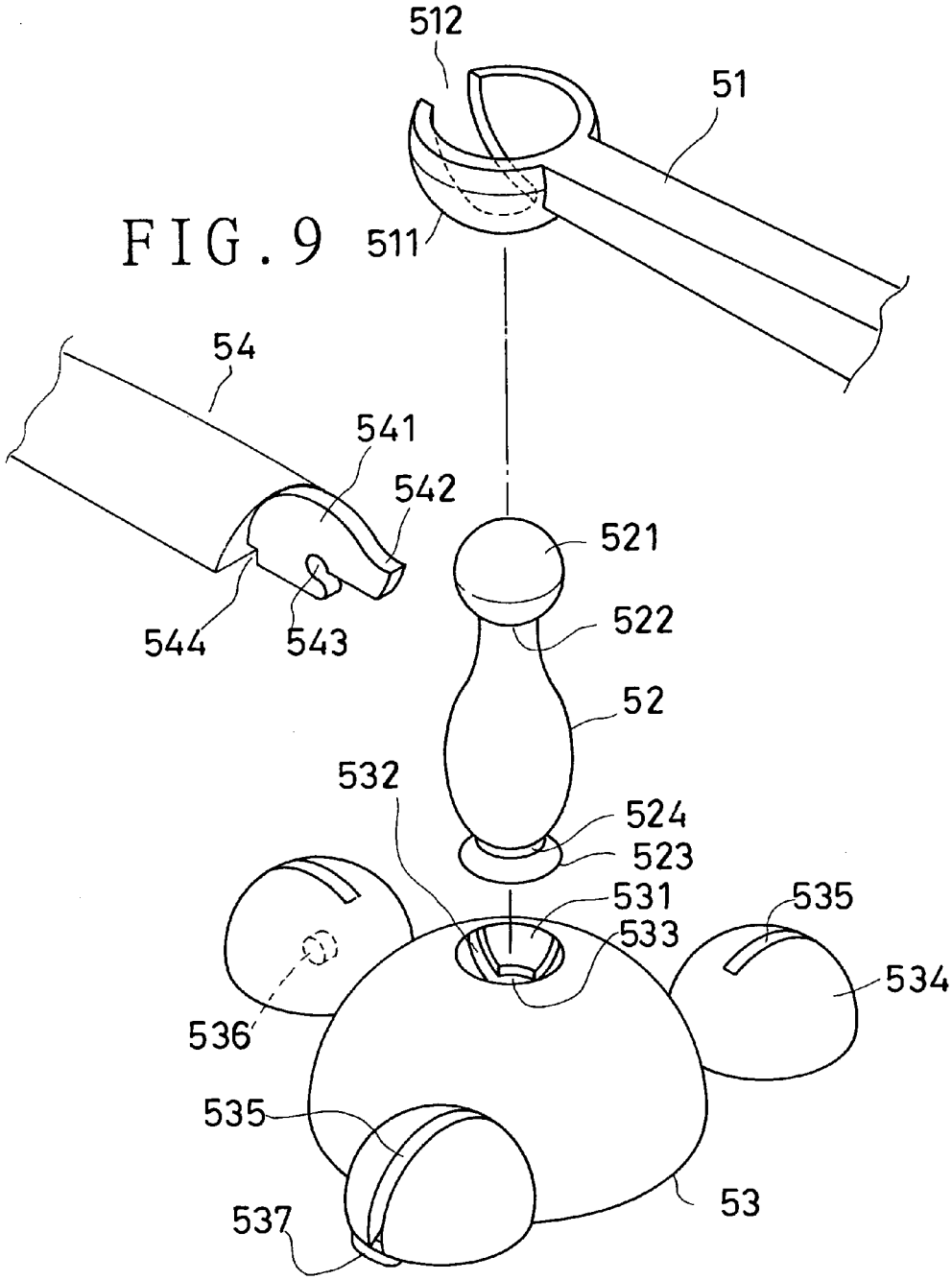
FIG. 9 is an exploded perspective view of the present toy hanger.

Referring to FIGS. 1, 2, and 9, a first embodiment of a music box of a play bed includes a music box member 1, two hanging hooks 3, and a toy hanger 5.

The music box member 1 has several buttons 11, and two fitting holes 12 formed on an upper side and near to respective ones of two adjacent edges, which are substantially perpendicular to each other. The box member 1 further has outwards facing protrusions 13 formed in the fitting holes 12, two hook holes 14 formed on vertical sides thereof and communicating with respective ones of the fitting holes 12, a raised portion 15 on a corner that is defined by the above mentioned adjacent edges, and a fitting cavity 16 on the raised portion 15.

Figure 4:
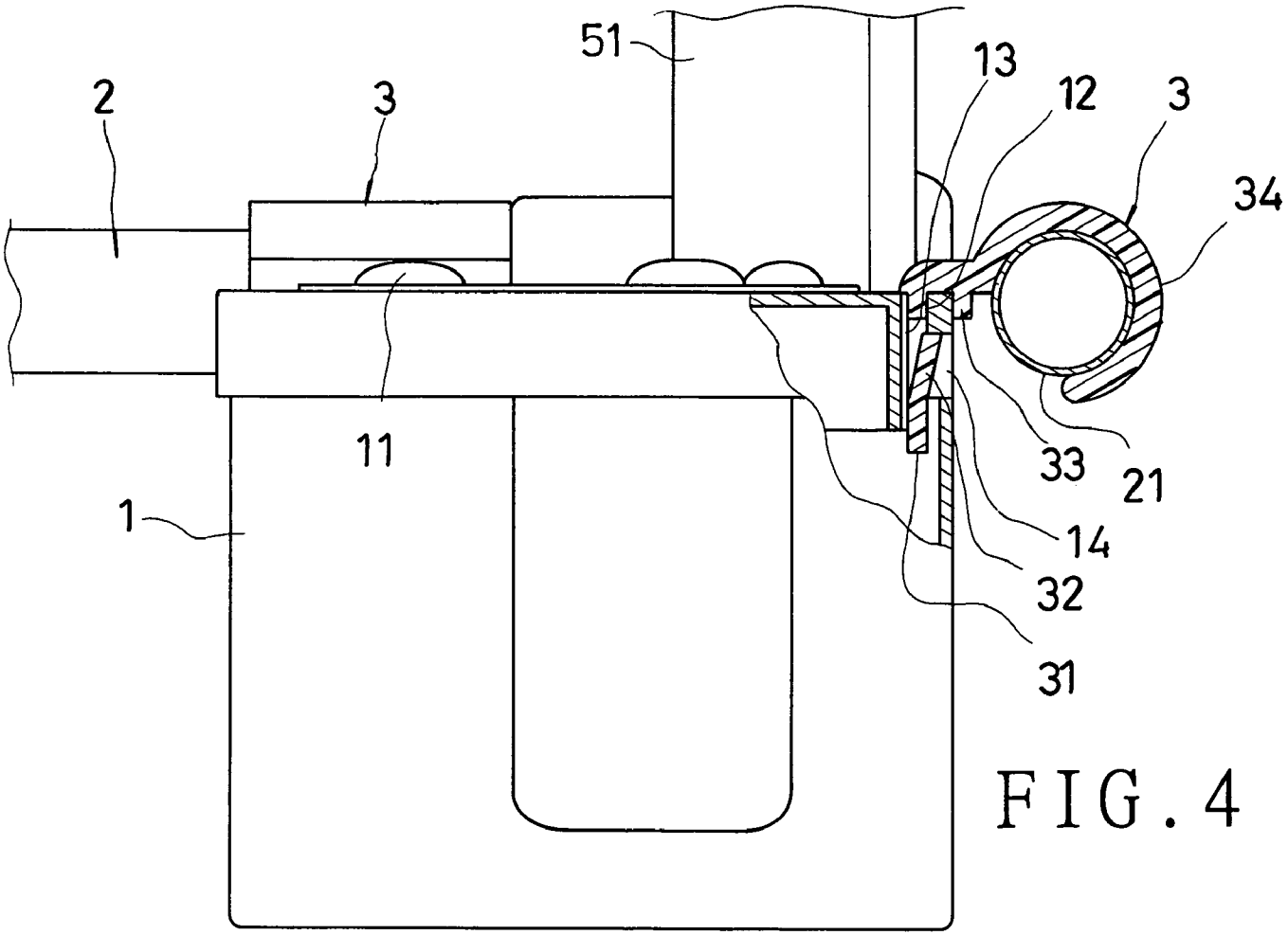
FIG. 4 is a partial vertical section of the present music box, with a hanging hook fitted thereto.
Figure 5:
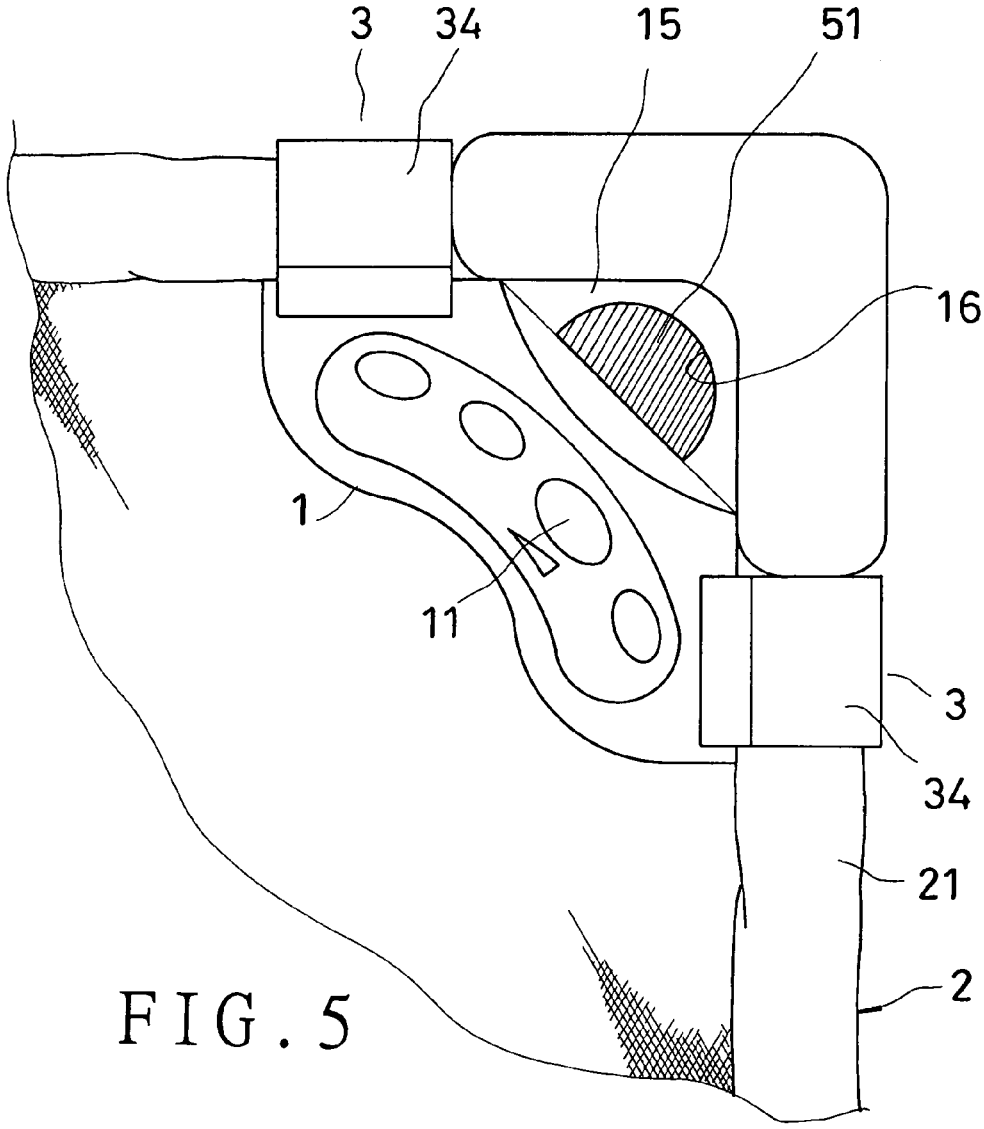
FIG. 5 is a top view of the music box of the present invention.

Each of the hanging hooks 3 has an insertion plate 31, a securing plate 32, a separating bar 33, and a hook portion 34; the securing plate 32 is connected to the insertion plate 31 at a lower end, and folded to project outwards at an upper end such that there is an angle between it and the insertion plate 31; referring to FIG. 2, the hook portion 34 is formed with such a curvature that it can be hooked over a frame 21 of a play bed 2 whose upper horizontal rod parts are cylindrical, and positioned at the same height, as shown in FIG. 4; the separating bar 33 is formed between the insertion plate 31 and the hook portion 34.

To hang the music box member 1 to the frame 21 of the play bed 2, first the hanging hooks 3 are inserted into respective ones of the fitting holes 12 at the insertion plates 31 with the insertion plates 31 being pressed against the protrusions 13 on inward sides thereof such that the securing plates 32 pass into, and engage the hook holes 14 automatically, and the separating bars 33 are closely pressed against upper edges of outward sides of the box member 1. Thus, the hanging hooks 3 are steady on the box member 1, and stopped from moving upwards to separate from the box member 1. Next, the hanging hooks 3 are hung on respective ones of two adjacent upper horizontal rod parts of the frame 21, as shown in FIG. 1; thus, the box member 1 is held steady on the play bed. In addition, the raised portion 15 will contact the rod parts of the frame 21 at vertical sides thereof to make the box member 1 steadier.

The hanging hooks 3 are made to become separable from the box member 1 by means of pushing the securing plates 32 away from the hook holes 14 of the box member 1.

The toy hanger 5 includes a curved support arm 51, a connecting rod 52 detachably connected with the support arm 51, a support body 53 detachably connected with the connecting rod 52, and several holding units 54 detachably connected with the support body 53 for hanging toys on; a lower end of the support arm 51 is shaped so as to fit the fitting cavity 16 of the box member 1, and the support arm 51 has a bowl-shaped connecting portion 511 at an upper end, on which a gap 512 is formed. The connecting rod 52 has a spherical fitting portion 521 at an upper end, a neck 522 adjacent to the fitting portion 521, a stopping portion 523 at a lower end thereof, and a neck 524 above, and adjacent to the stopping portion 523; the neck 522 has a smaller diameter than the spherical fitting portion 521 while the neck 524 has a smaller diameter than the stopped portion 523. The support body 53 has several spaced elastic plates 531 on a middle thereof; every two adjacent ones of the elastic plates 531 have a space 532 between them, and the elastic plates 531 together define both a recess (not numbered) on the support body 53 and a through hole 533 between them. The support body 53 has several equidistantly spaced fitting portions 534 around the middle thereof, each of which has an opening 535, a pivotal portion 536 secured to substantially middles of lower edges of two opposing sides that define the opening 535, and a locating portion 537 secured to outward ends of the lower edges of the opposing sides, which define the opening 535. The holding units 54 are used for hanging toys on. Each of the holding units 54 has a fitting end 541, a stopped edge 542 on a tip of the fitting end 541, both a pivotal hole 543 and a fitting gap 544 on a lower edge of the fitting end 541, and several toys 546 hung thereon by means of strings 545.

Figure 10:
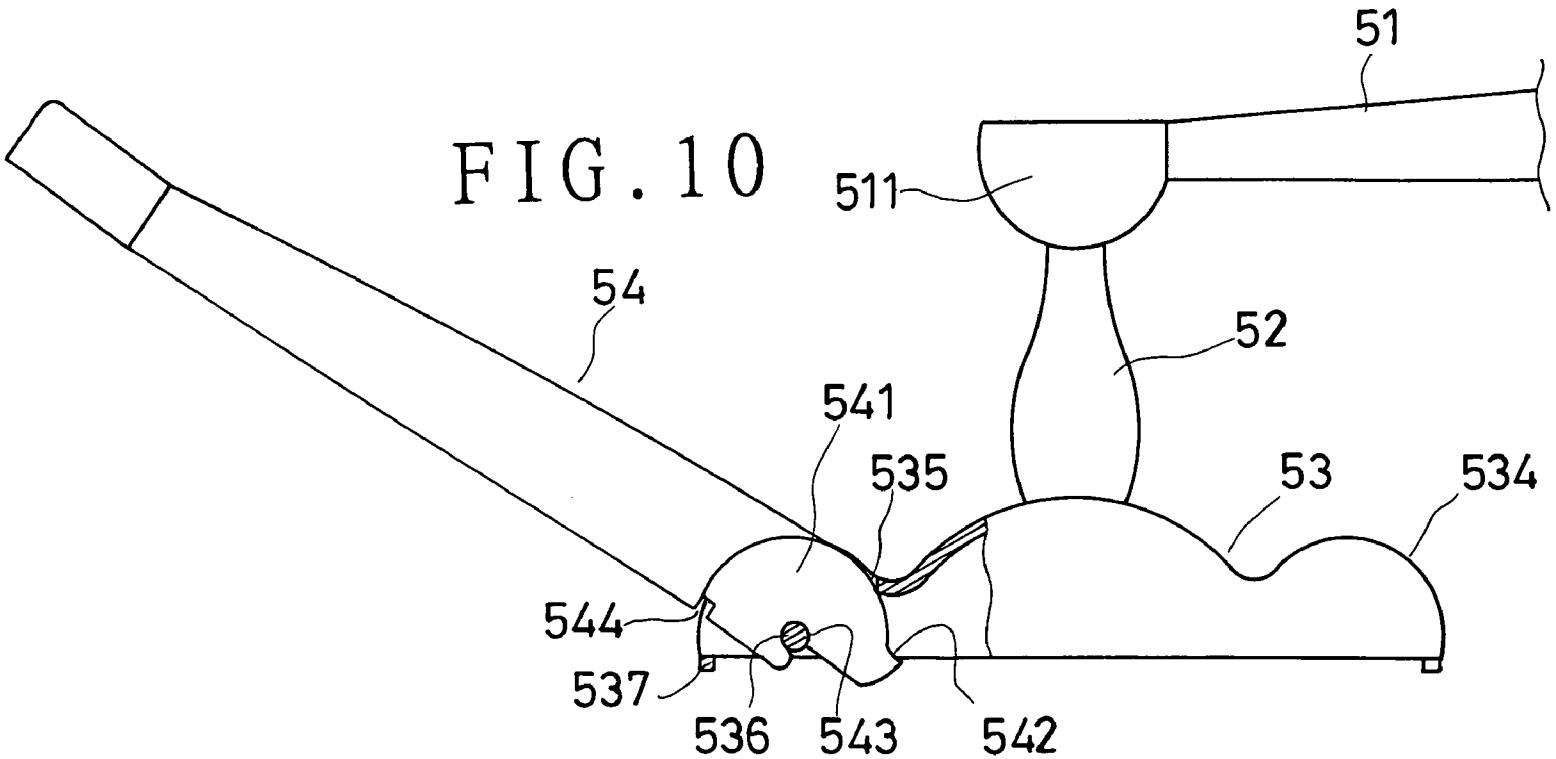
FIG. 10 is a side view of the toy hanger, in the assembling process.

To connect the connecting rod 52 with the support arm 51, the connecting rod 52 is passed into the gap 512 of the upper end of the support arm 51 such that the spherical fitting portion 521 will be held in the bowl-shaped portion 511 to prevent the connecting rod 52 from falling. To connect the connecting rod 52 to the support body 53, the connecting rod 52 is passed through the through hole 533 at the lower end. And, referring to FIG. 10, to fit the holding units 54 to the support body 53, first the holding units 54 are passed into the openings 535 in a sloping position so as to connect the pivotal portions 536 at the pivotal holes 543 thereof, and then pivoted downwards for connecting the fitting gaps 544 to the locating portions 537.

Figure 11:
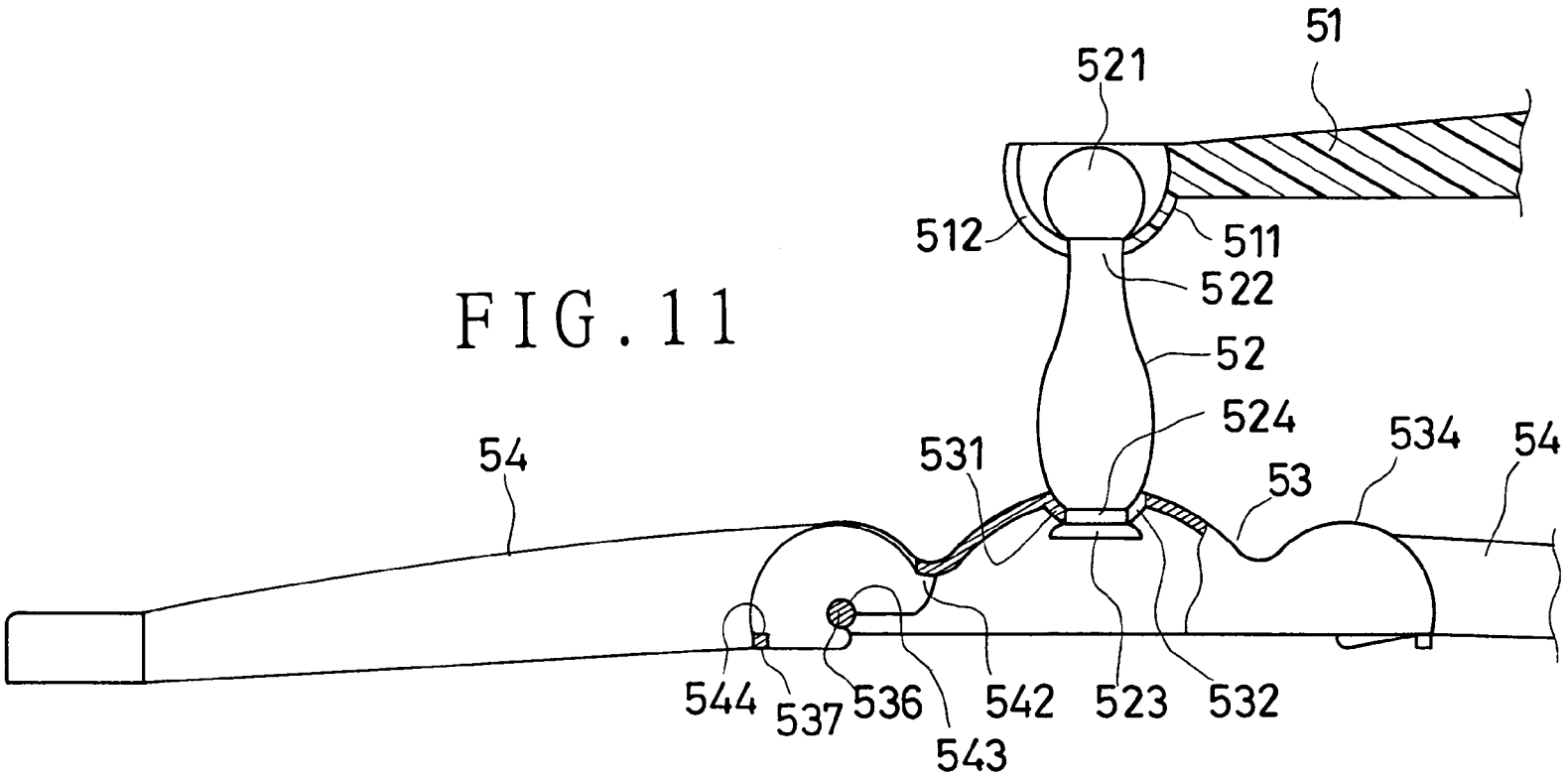
FIG. 11 is a partial side view of the toy hanger, assembled.

Thus, after assembly of the toy hanger 5, the connecting rod 52 will be hung on the support arm 51 with the spherical fitting portion 521, and the neck 522 thereof being respectively held in the bowl-shaped connecting portion 511, and the gap 512. And, the support body 53 will be hung on the connecting rod 52 with the elastic plates 531 being fitted around the neck 524 so that the stopping portion 523 of the rod 52 is right under the elastic plates 531 to prevent the support body 53 from falling. The holding unit 54 will be supported in substantially horizontal position by means of respective ones of the fitting portions 534 with the fitting ends 541 being held in the openings 535, the pivotal portions 536 in the pivotal holes 543, the stopped edges 542 pressed against inner sides of the support body 53, and the locating portions 537 in the fitting gaps 544, as shown in FIG. 11.

Figure 12:
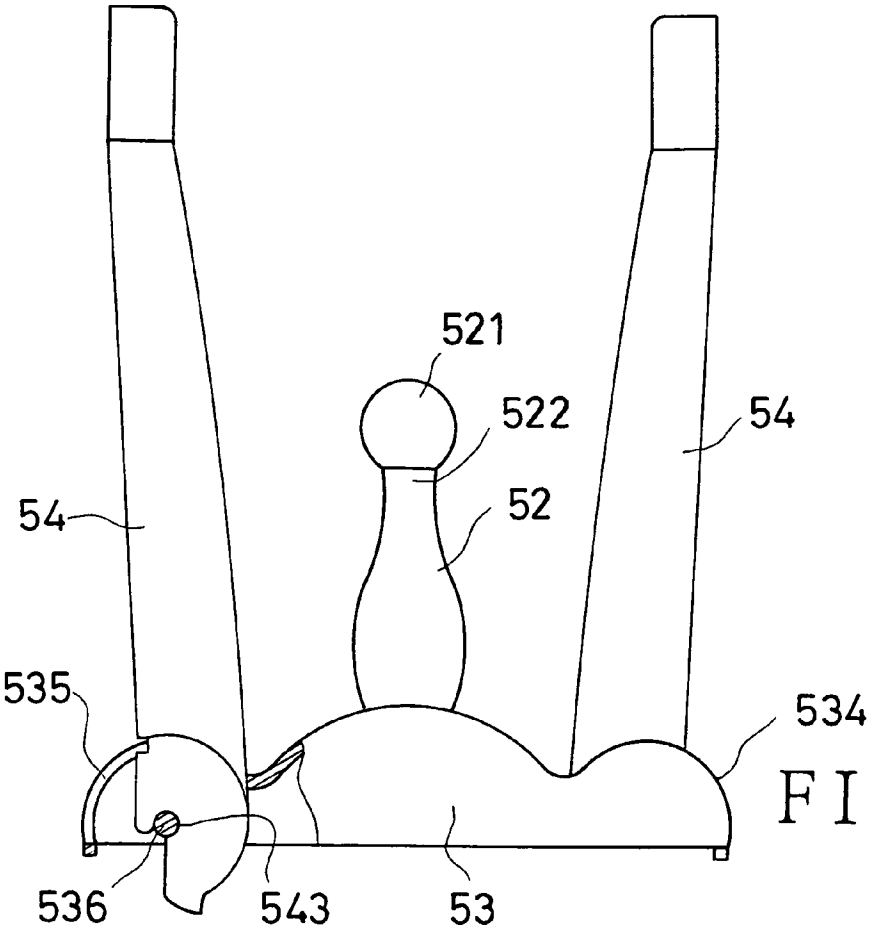
FIG. 12 is a partial side view of the toy hanger, in folded position.

Thus, while the box member 1 is hung on the frame 21 of the play bed 2, and used to play music, the toy hanger 5 can be fitted on the box member 1 by means of inserting the lower end of the support arm 51 in the fitting cavity 16 so that a baby can play with the toys hung on the holding units 54. When the toy hanger 5 is not used, the support arm 51 can be separated from the connecting rod 52, and the holding units 54 pivoted on the pivotal portions 536 to a substantially upright position (FIG. 12) after the toy hanger 5 is removed from the box member 1; thus, the toy hanger 5 will occupy less space in storage.

Figure 6:
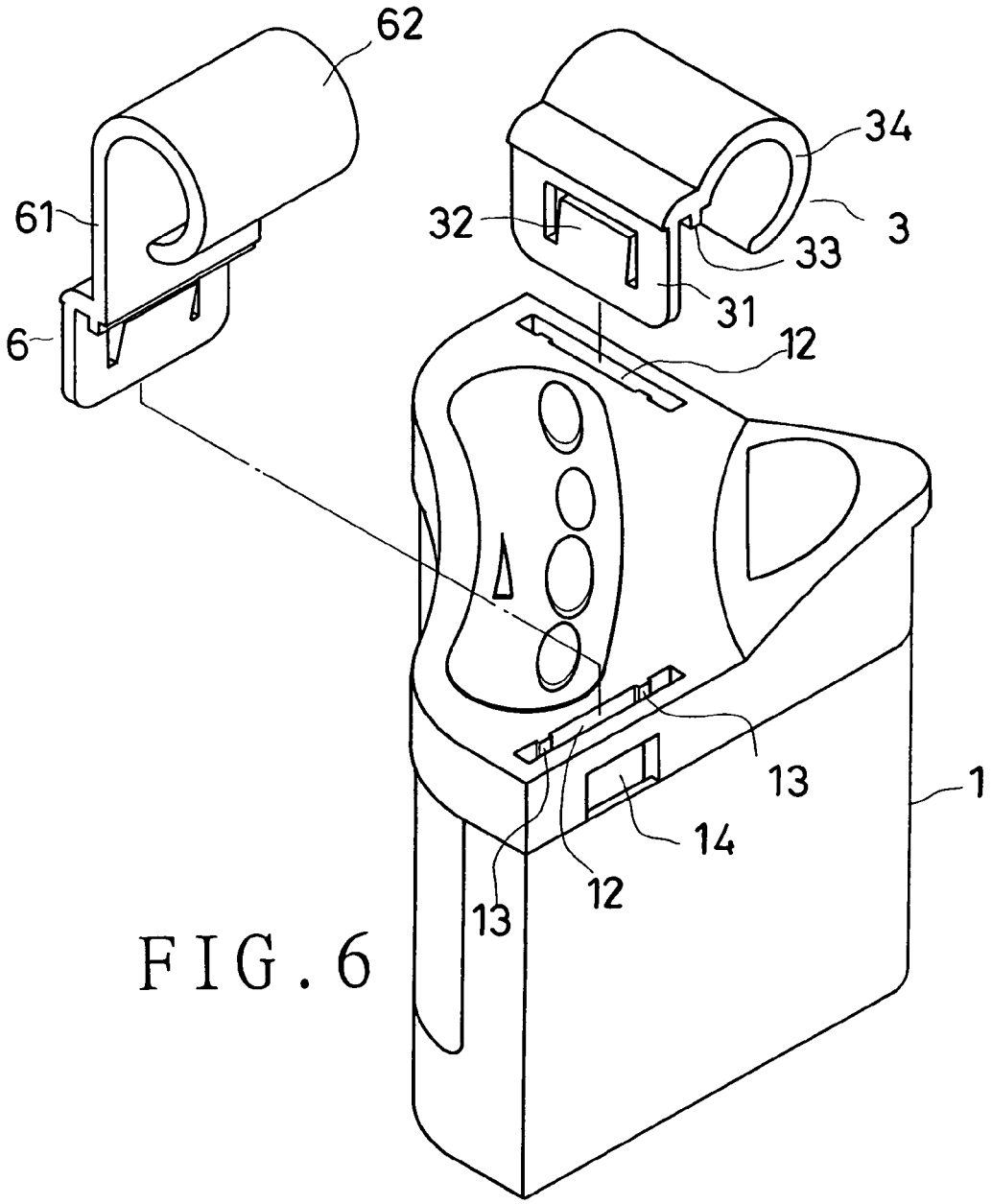
FIG. 6 is a partial exploded perspective view of the second embodiment of a music box in the present invention.

Referring to FIG. 6, in a second embodiment, one of the hanging hooks 3 for the music box member 1 is replaced with a hanging hook 6, which is basically the same as the hanging hooks 3, but has a vertical wall portion 61, to which a hook portion 62 thereof is connected, such that the hook portion 62 will be higher than the hook portion 34 of the hook 3 after the hooks 3 and 6 are fitted to respective ones of the fitting holes 12 of the box member 1. Thus, with the help of one of the hanging hooks 3, and the hanging hook 6, the music box can be hung on a frame of a play bed whose upper horizontal rod parts are positioned at different heights.

Figure 7:
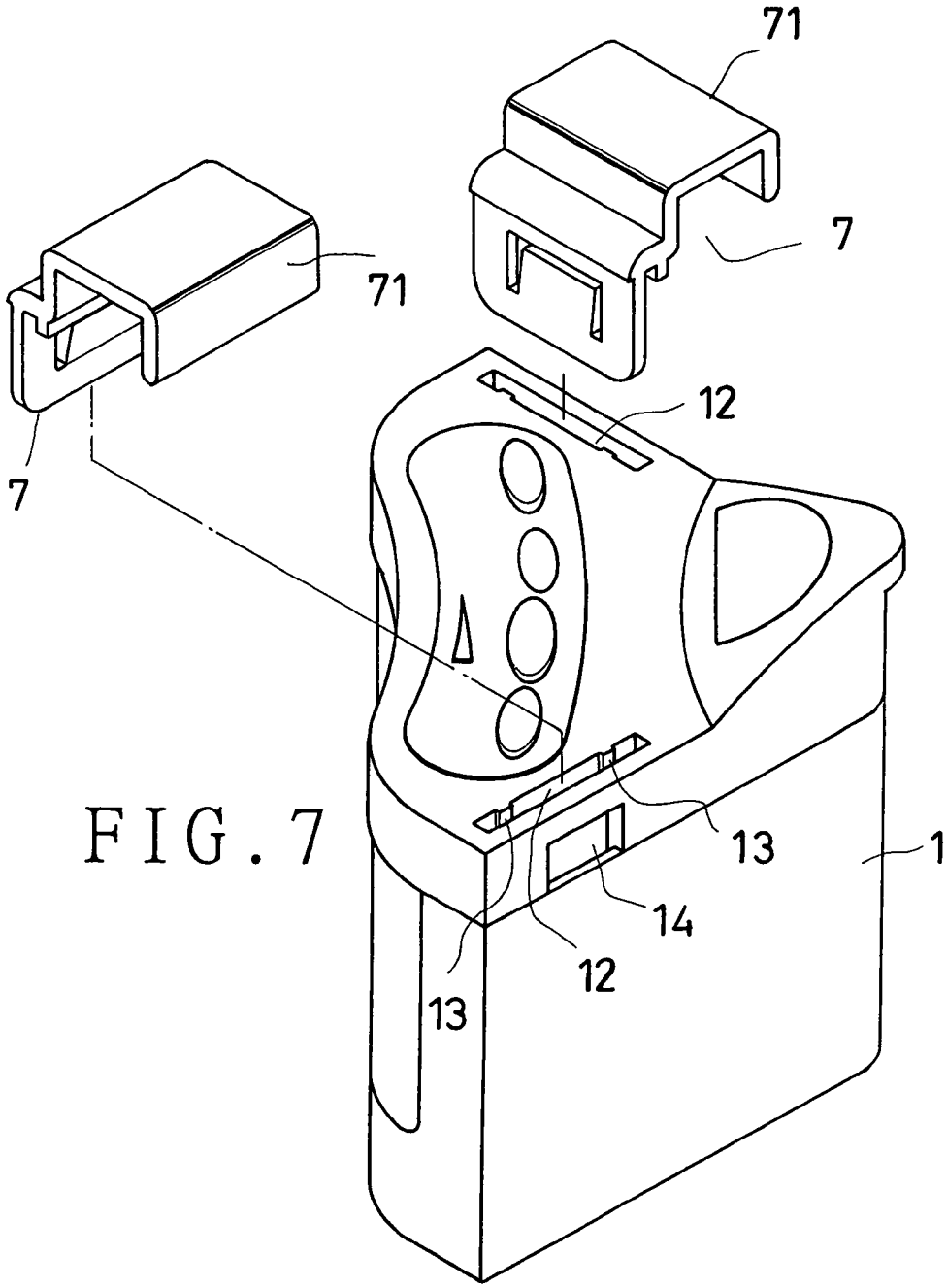
FIG. 7 is a partial exploded perspective view of the third embodiment of a music box in the present invention.

Referring to FIG. 7, in a third embodiment, the hanging hooks 3 for the music box member 1 is replaced with hanging hooks 7, which are basically the same as the hanging hooks 3, but have hook portions 71 each having a ⊓-shaped vertical cross-section, including a horizontal side, and two vertical sides projecting down from edges of the horizontal side thereof. Thus, with the help of the hanging hook 7, the music box can be hung on a wooden frame of a play bed whose upper horizontal rod parts are positioned at the same height, and are square or rectangular.

Figure 8:
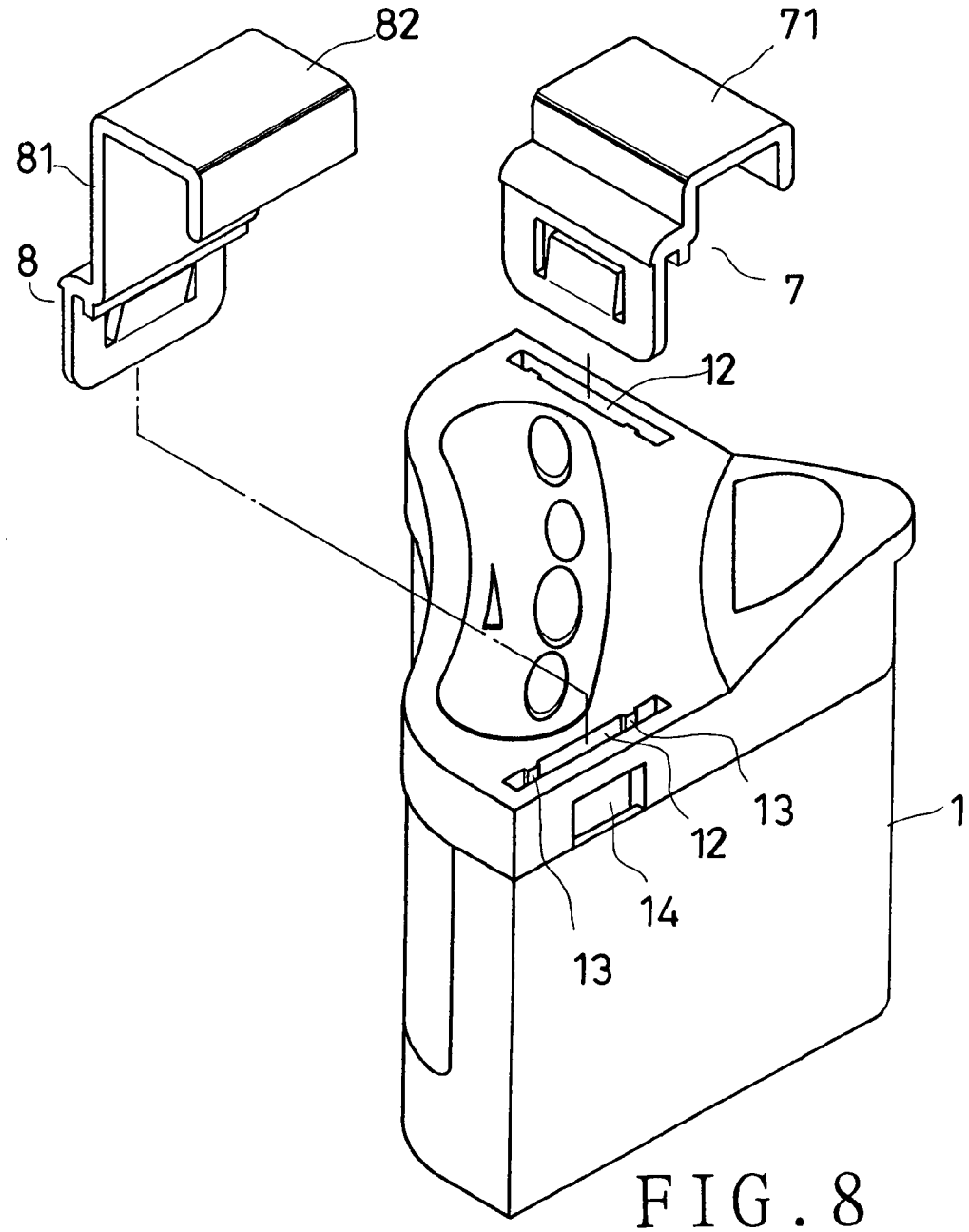
FIG. 8 is a partial exploded perspective view of the fourth embodiment of a music box in the present invention.

Referring to FIG. 8, in a fourth embodiment, one of the hanging hooks 7 for the music box member 1 is replaced with a hanging hook 8, which is basically the same as the hanging hooks 7, but has a vertical wall portion 81, to which a hook portion 82 similar to the hook portions 71 is connected, such that the hook portion 82 will be higher than the hook portion 71 of the hook 7 after the hooks 7 and 8 are fitted to respective ones of the fitting holes 12 of the box member 1. Thus, with the help of one of the hanging hooks 7, and the hanging hook 8, the music box can be hung on a wooden frame of a play bed whose upper horizontal rod parts are square or rectangular, but are positioned at different heights.

From the above description, it can be easily understood that the music box of a play bed has advantages as followings:

1. Because the hanging hooks are detachable from the music box member 1, and various types of hanging hooks are available, the music box member 1 can be hung on various types of play beds for use with the help of suitable hanging hooks.
2. Because the toy hanger 5 is detachably connected to the box member 1, it can be removed from the box member 1 when not used.
3. The toy hanger 5 can be folded to occupy less space for easy storage therefore the present invention is convenient to use.

What is claimed is:

1. A music box of a play bed, comprising a music box member used for playing music; the box member having two fitting holes formed on an upper side and near to respective ones of two adjacent edges thereof; the box member having a fitting cavity on a corner that is defined by said adjacent edges;

two hanging hooks used for hanging the box member on two adjacent upper horizontal rod parts of a frame of a play bed; each of the hanging hooks having an insertion plate, which is inserted in a respective one of the fitting holes of the box member, and detachably secured to the box member; each of the hanging hooks having a hook portion connected with an upper end of the insertion plate; the hook portions being detachably hooked over respective ones of the upper horizontal rod parts of the frame; and a toy hanger including:

(1) a curved support arm detachably fitted to, and held in position by the box member with at a lower end thereof being inserted in the fitting cavity of the box member; the support arm having a connecting portion at an upper end thereof, on which a gap is formed;

(2) a connecting rod detachably connected with the support arm; the connecting rod having a spherical fitting portion at an upper end, and a first neck adjacent to the spherical fitting portion; the connecting rod having a stopping portion at a lower end thereof, and a second neck above, and adjacent to the stopping portion; the first neck having a smaller diameter than the spherical fitting portion; the second neck having a smaller diameter than the stopped portion;

(3) a support body detachably connected with the lower end of the connecting rod; the support body having a plurality of spaced elastic plates on a middle thereof; every two adjacent ones of the elastic plates having a space between them; the elastic plates together defining both a recess on the support body and a through hole between them; the support body having a plurality of equidistantly spaced fitting portions formed around it, each of which has an opening, a pivotal portion in a substantially middle portion of a lower portion of the opening, and a locating portion in an outward end of the lower portion of the opening;

(4) a plurality of holding units for hanging toys on; the holding units being detachably connected with, and held substantially horizontal by respective ones of the fitting portions of the support body; each of the holding units having a fitting end inserted in a corresponding opening of the support body; each of the holding units having a pivotal hole and a fitting gap on a lower edge of the fitting end thereof, in which a corresponding fitting portion of the support body are fitted at the pivotal portion, and the locating portion respectively.

2. The music box as claimed in claim 1, wherein the box member has outwards facing protrusions formed in the fitting holes thereof such that the insertion plates of the hanging hooks will be pressed against the protrusions on inward sides thereof after being inserted in the fitting holes.

3. The music box as claimed in claim 2, wherein the box member has a raised portion for contacting the frame of the play bed, which is formed on the corner of the upper side, on which the fitting cavity is formed.

4. The music box as claimed in claim 2, wherein each of the hanging hooks has a separating bar formed between the insertion plate and the hook portion, which separating bar will be closely pressed against an upper edge of an outward side of the box member for helping hold the box member steady after the hanging hook is fitted in the fitting hole at the insertion plate thereof.

5. The music box as claimed in claim 4, wherein the box member has a raised portion for contacting the frame of the play bed, which is formed on the corner of the upper side, on which the fitting cavity is formed.

6. The music box as claimed in claim 1, wherein each of the hanging hook has a securing plate, which is connected to the insertion plate at a lower end, and folded to project outwards at an upper end such that there is an angle between the securing plate and the insertion plate, and the box member has two hook holes, which are formed on outer sides and communicate with respective ones of the fitting holes; the securing plates being going to pass into, and engage the hook holes automatically after the hanging hooks are fitted in the fitting holes of the box member at the insertion plates thereof.

7. The music box as claimed in claim 6, wherein the box member has a raised portion for contacting the frame of the play bed, which is formed on the corner of the upper side, on which the fitting cavity is formed.

8. The music box as claimed in claim 6, wherein each of the hanging hooks has a separating bar formed between the insertion plate and the hook portion, which separating bar will be closely pressed against an upper edge of an outward side of the box member to help hold the box member steady after the hanging hook is fitted in the fitting hole at the insertion plate thereof.

9. The music box as claimed in claim 8, wherein the box member has a raised portion for contacting the frame of the play bed, which is formed on the corner of the upper side, on which the fitting cavity is formed.

10. The music box as claimed in claim 2, wherein each of the holding units has a stopped edge on a tip of the fitting end, which is pressed against an inner side of the support body when the holding unit is held in a substantially horizontal in-use position by the support body.

11. The music box as claimed in claim 10, wherein the box member has a raised portion for contacting the frame of the play bed, which is formed on the corner of the upper side, on which the fitting cavity is formed.

12. The music box as claimed in claim 10, wherein each of the hanging hooks has a separating bar formed between the insertion plate and the hook portion, which separating bar will be closely pressed against an upper edge of an outward side of the box member to help hold the box member steady after the hanging hook is fitted in the fitting hole at the insertion plate thereof.

13. The music box as claimed in claim 12, wherein the box member has a raised portion for contacting the frame of the play bed, which is formed on the corner of the upper side, on which the fitting cavity is formed.

14. The music box as claimed in claim 1, wherein the hook portions of the hanging hooks are curved for suiting a play bed whose frame consists of cylindrical rod parts.

15. The music box as claimed in claim 14, wherein one of the hanging hooks has a vertical wall portion, which is added between the hook portion and the insertion plate thereof.

16. The music box as claimed in claim 1, wherein each of the hook portions of the hanging hooks has a horizontal side, and two vertical sides projecting down from edges of the horizontal side thereof such that the hook portions suit a play bed whose frame consists of rectangular rod parts.

17. The music box as claimed in claim 16, wherein one of the hanging hooks has a vertical wall portion, which is added between the hook portion and the insertion plate thereof.

* * * * *